United States Patent [19]

Schommler et al.

[11] Patent Number: 4,765,216

[45] Date of Patent: Aug. 23, 1988

[54] KNIFE SHAFT PAIR FOR CUTTING WEB-LIKE MATERIAL, IN PARTICULAR UNDULATED BOARD

[75] Inventors: Manfred Schommler; Gerald Martin, both of Hamburg, Fed. Rep. of Germany

[73] Assignee: Peter Maschinenfabrik GmbH, Hamburg, Fed. Rep. of Germany

[21] Appl. No.: 80,774

[22] Filed: Aug. 3, 1987

[30] Foreign Application Priority Data

Aug. 7, 1986 [DE] Fed. Rep. of Germany ..... 3626748

[51] Int. Cl.[4] ..... B26D 1/62

[52] U.S. Cl. ..... 83/341; 83/345; 83/673

[58] Field of Search ..... 83/341, 345, 673, 674, 83/595, 596

[56] References Cited

U.S. PATENT DOCUMENTS 3,570,363 3/1971 Thomas ..... 83/345 X
4,399,727 8/1983 Omori et al. ..... 83/345

FOREIGN PATENT DOCUMENTS 2610355 10/1976 Fed. Rep. of Germany .
3521238 12/1986 Fed. Rep. of Germany .
507786 7/1971 Switzerland .

*Primary Examiner*—Frank T. Yost
*Attorney, Agent, or Firm*—Harness, Dickey & Pierce

[57] ABSTRACT

Knife shaft pair for cutting web-like material, in particular undulated board, wherein the knives contact each other temporarily under bias, if necessary, shortly before termination of the cutting operation, the cutting edge lying at the trailing side of a first knife being formed in a manner known per se so as to be uniformly continuous with an equal spacing from the shaft axis, the other knife having a saw-toothed cutting edge whose teeth extend, commencing from the continuous line of contact with the first knife, away from the shaft of the second knife and in the approximation region of the knives at an acute angle to the connecting plane between the line of contact and the uniform cutting edge such that they lie at the trailing or the leading side of the first side during the cutting operation.

4 Claims, 3 Drawing Sheets

Fig. 4 PRIOR ART
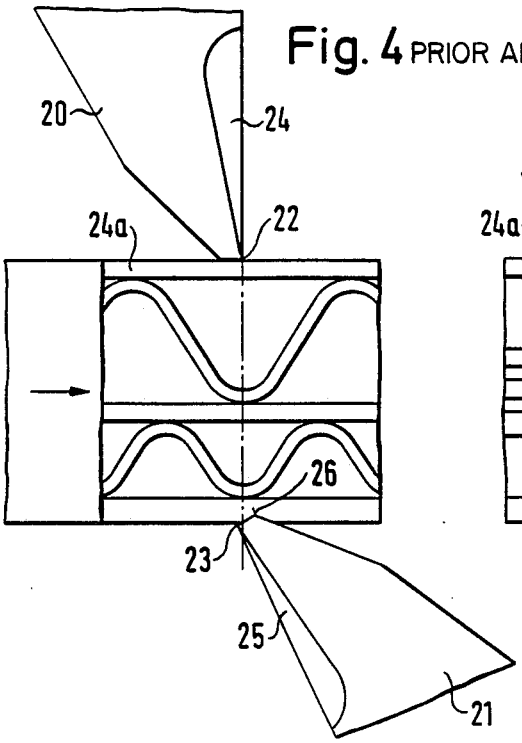
Fig. 5 PRIOR ART
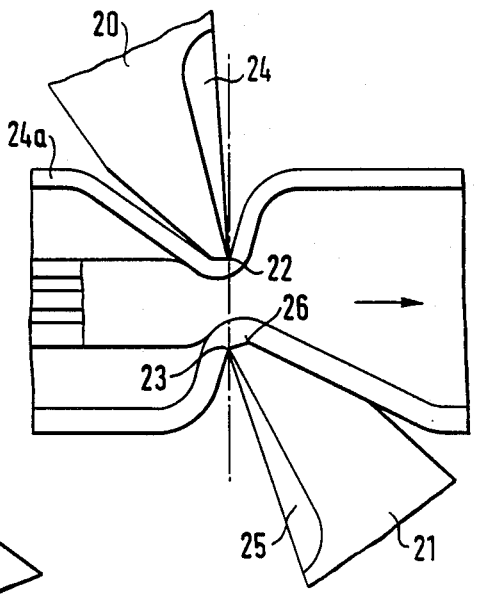
PRIOR ART Fig. 6
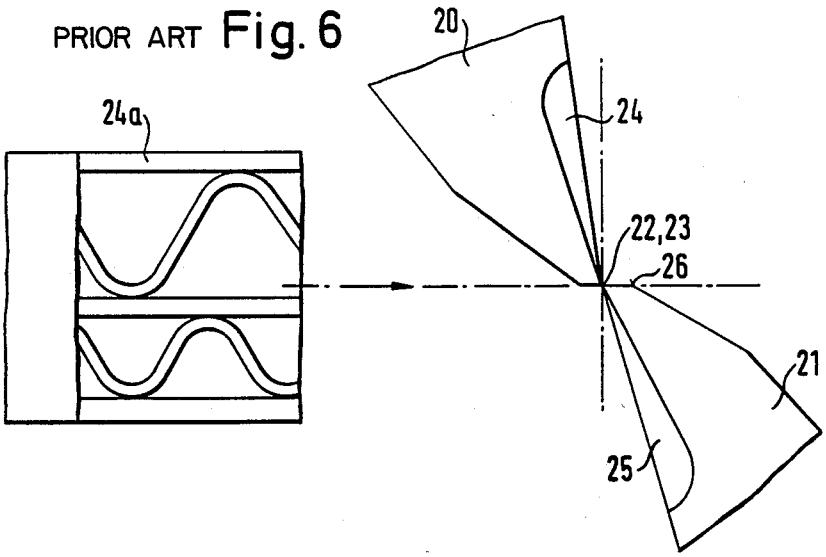

KNIFE SHAFT PAIR FOR CUTTING WEB-LIKE MATERIAL, IN PARTICULAR UNDULATED BOARD

BACKGROUND OF THE INVENTION

The invention relates to a knife shaft pair for cutting web-like material, in particular undulated board, wherein the knives contact each other temporarily under bias, if necessary, shortly before termination of the cutting operation.

In cross-cutters for undulated board manufacturing systems knife shaft pairs are normally used, wherein each shaft pair holds at least one knife with a uniformly extending cutting edge which has an equal spacing from the shaft axis. The knife blade extends either in parallel to the shaft axis or is arranged helically. The helical arrangement has the advantage that during the cutting operation always only a short section of the cutting edges is in engagement with one another at a single instant, whereby the loading on the knives, the knife retainer and the shafts is maintained low. The cutting edges of the knives describe circles which intersect slightly. The cutting edge of the one knife is in the leading area and the other in the trailing area of the knife blade. The radius of revolution of the cutting edge in the trailing area is slightly larger than the radius of the other cutting knife, so that only a single contact of the cutting edges occurs during one revolution and the cutting edges are moved apart relatively quickly after that contact. To ensure an unobjectionable cut, the cutting edges must be biased towards each other, i.e. they abut against one another under a partially considerable bias during the contact.

Such knife shaft pairs have generally proved satisfactory. With relatively tough material or from a certain grammage of the undulated board on or also with moist or coated undulated board a considerable bias is required to obtain an unobjectionable cut. In a boarderline case, no clear cut is obtained at all. A high bias necessitates high cutting forces. High cutting forces necessitate an adjustment of the knives at relatively short intervals, which causes an undesirous interruption of production. High cutting forces also cause rapid wear of the knives.

Hence, the object of the invention is to provide a knife shaft pair for cutting web-like material, in particular undulated board, which enables longer adjustment intervals and a longer service life.

SUMMARY OF THE INVENTION

In accordance with the invention, this object is solved in that the cutting edge lying at the trailing side of a first knife is formed in a manner known per se so as to be uniformly continuous with an equal spacing from the shaft axis, that the other knife includes a sawtoothed cutting edge whose teeth extend, commencing from the continuous line of contact with the first knife, away from the shaft of the second knife and in the approximation region of the knives at an acute angle to the connecting plane between the line of contact and the uniform cutting edge such that they lie at the trailing or leading side of the knife during the cutting operation.

So-called sawtoothed knives are known per se. They are employed e.g. with fly cutters. They are also used in socalled short cross cutters in undulated board systems. The saw-toothed knife resting on a shaft coacts with a Vulkolan roller, the teeth digging into the counter roller during the cutting operation. Since there are only relatively few cutting operations with short cross cutters, they are satisfactory in this case. With cross cutters with several cutting operations per second, such coaction of saw-toothed knives with a Vulkolan roller would be unacceptable.

In the knife shaft pair according to the invention, a continuous line of contact remains between the two knives during the cutting operation. The teeth of the saw-toothed edge effect a preperforation and thus an improved distribution of the cutting forces over the cutting area. The latter can extend over the entire length of the knife shafts; preferably, however, a known-per-se helical arrangement of the knives is chosen. The reduced cutting forces also yield a reduced radial loading on the knives, the knife retainer and the knife bars. Also, the perforation yields a reduced squeezing effect in a horizontal direction, thereby decreasing the loading on the components also in a horizontal direction. Due to the reduced cutting forces and thus also the horizontal component thereof a receduced knife bias is necessary, which in turn reduces the loading on the components. The intervals at which it is necessary to adjust the knives are considerably prolonged. Also knife wear is drastically reduced. The invention therefore reduces considerably the maintenance expenditure and interruptions of production due to adjustments and exchange of the knives.

The position of the teeth overlapping the counter knife cutting edge with respect to the counter knife depends on which of the two knives is leading. If the counter knife is leading, the teeth lie on the trailing side of the counter knife. If, on the other hand, the saw-toothed knife is leading, the teeth lie at the leading side of the counter knife.

Advantageous modifications of the invention are recited in the subclaims.

BRIEF DESCRIPTION OF THE DRAWINGS

The invention will now be set forth below with reference to the accompanying drawings, in which:

FIGS. 4 to 6 are various instants of a cutting operation with a conventional knife shaft pair;

DETAILED DESCRIPTION OF THE PREFERRED EMBODIMENT OF THE INVENTION

Figure 1:
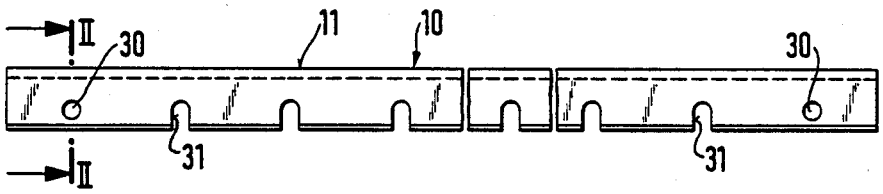
FIG. 1 is a top view of a knife of a knife shaft pair according to the invention.

Before dealing more closely with the details shown in the drawings, it is premised that each of the described features is of essential significance per se or in conjunction with features of the specification.

Figure 2:
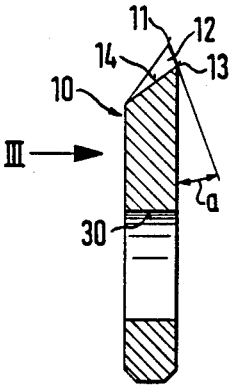
FIG. 2 is a section through the knife of FIG. 1 along the line 2—2.
Figure 3:
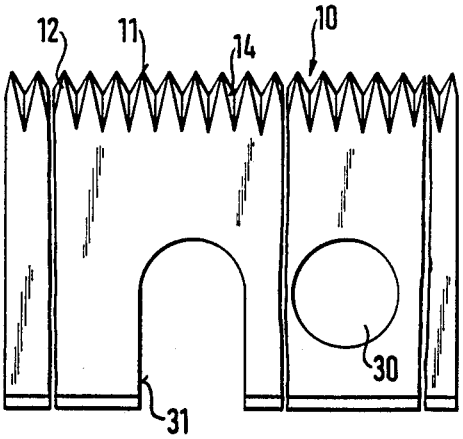
FIG. 3 is an enlarged side view of the trailing side of the knife of FIG. 1 in the direction of the arrow 3 in FIG. 2.

FIGS. 1 to 3 show a knife blade 10 of conventional crosssection, with the exception of a saw-toothed cutting edge 11 by which are formed individual teeth 12 whose shape are shown in FIGS. 2 and 3. It is apparent that the teeth 12 are formed by corresponding grinding from an oblique side of the knife blade, yielding, in a side view, teeth and gaps triangular in contour. As shown in FIG. 2, the tooth tips are offset with respect to the right side of the knife blade 10 in FIG. 2, which is the leading side. The plane in which the teeth extend at this side is inclined by an angle a with respect to the leading side of the knife blade 10. The apices of the gaps lie on a common continuous line parallel to the axis of the knife blade 10 and denoted by 13 in FIG. 2. As viewed in the direction of the arrow 3, a tooth configuration according to FIG. 3 is obtained, i.e. formed are indentations 14 having a triangular cross-section. The upper edges of the indentations 14 are formed by straight lines which commence at the tooth tips and extend each therefrom convergingly at an acute angle between a gap.

FIGS. 4 to 6 show a cutting operation with a conventional knife shaft pair. Knives 20,21 are conventionally mounted on knife shafts. The knives 20,21 extend preferably helically, so that always only a limited length of the cutting edges 22,23 is in engagement with the undulated board 24 during the cutting operation. Thereby it is possible to maintain the cutting forces lower and to reduce wear of the knives. The knives 20,21 are also biased towards each other so as to attain an unobjectionable cutting effect. The knives 20,21 are provided with rakes 24, 25 in a manner known per se. In FIGS. 4 to 6, the direction of movement of the undulated board **24*a* is from left to right. The lower shaft with the knife 21 is rotated in a clockwise direction, while the upper shaft is rotated in a counterlockwise direction. According to the illustration in FIG. 4, the knives 20,21 contact the cover faces of the undulated board 24*a*, a leading edge 26 of the knife 21 being slightly urged into the lower cover face. In the illustration of FIG. 5, the undulated webs are pressed together, and all five webs of the undulated board 24*a* are more or less pressed onto each other, without a segregation having been performed. This is finally terminated only when the cutting edges 22,23 abut each other under bias, as shown in FIG. 6**.

Figure 7:
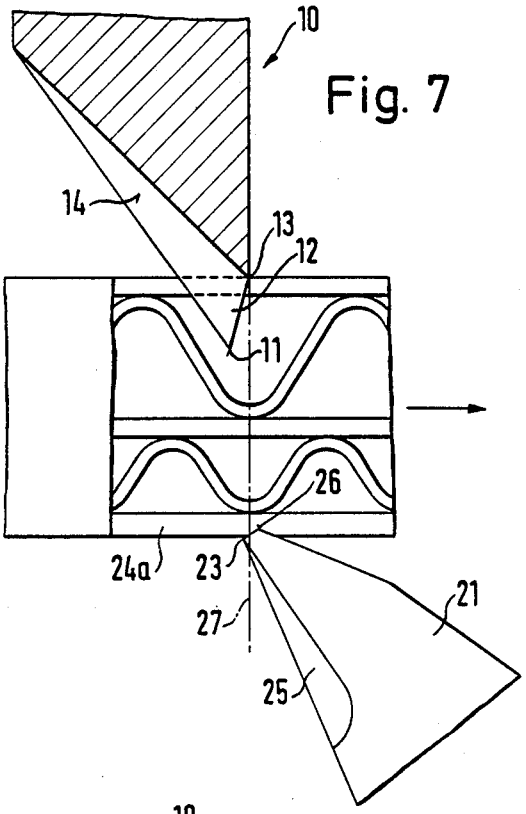
FIGS. 7 and 8 are two temporally deviating instants of a cutting operation with the knife shaft pair according to the invention.
Figure 8:
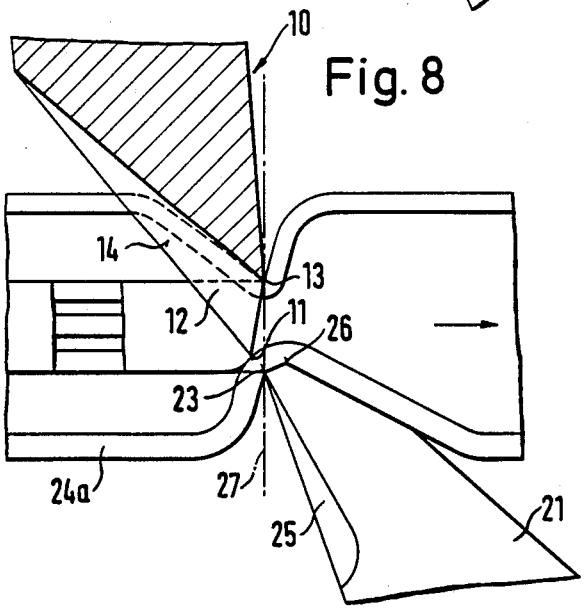

In the knife shaft pair according to FIGS. 7 and 8, the lower leading knife is formed conventionally, as shown in FIGS. 4 to 6. The upper knife is, however, the saw-toothed knife 10 according to FIGS. 1 to 3. FIG. 7 corresponds temporally to the arrangement of the knives in a conventional way according to FIG. 4. It is apparent that the teeth 12 have already dug into the upper cover layer and perforatingly penetrated the same. This is due to the fact that the teeth 12 extend farther in the direction of the lower knife with respect to the line of contact 13 between the upper knife 10 and the lower knife 21. The teeth form an acute angle with respect to the connecting plane 27 between the lines of contact 13,23, so that the teeth 12 are always at the trailing side of the knife 21 during the cutting operation (cf. also FIG. 8). Before the cutting edge 23 of the lower knife 21 abuts against the continuous line 13 of the upper knife 10 under small bias, the respective teeth 12 and the thus formed saw-toothed cutting edge 11 have substantially cut all layers of the board **24*a*, the cutting operation being also terminated only when the cutting edge 23 abuts against the line of contact 13. The bias required therefor is, however, by far lower than with a knife arrangement according to FIGS. 4 to 6. This, as previously described, is due to the by far smaller cutting forces which can be provided owing to the saw-toothed cutting edge 11**.

The knives 10,21 can also be hellically mounted on the shaft in a conventional manner. The attachment is of a conventional type. To this end, the knife 10 has bores 30 at the ends and recesses 31 for attachment in the knife retainer at the lower edge.

We claim:

1. A knife shaft pair supported on respective shafts for cutting web-like material such as undulated board, said knives having cooperating cutting edges other temporarily under bias, if necessary, shortly before termination characterized in that the cutting edge lying at the trailing side of a first knife is uniformly continuous with an equal spacing from the respective shaft axis, the second knife having a saw-toothed cutting edge whose teeth extend from a continuous line of contact with said second knife and in the approximation region of the knives at an acute angle to the connecting plane between the line of contact and the uniform cutting edge of the first knife to lie at one side of the first knife during the cutting operation so that said teeth effect initial perforations of the material being cut at spaced locations along the line of contact.

2. A knife shaft pair as in claim 1, characterized in that the teeth and the gaps formed between the teeth are triangular.

3. A knife shaft pair as in claim 1, characterized in that the teeth are formed by grinding in an oblique surface extending over the width of the knife blade.

4. A knife shaft pair as in claim 3, characterized in that the indentations forming the gaps are depressions triangular in cross-section.

* * * * *